United States Patent [19]

Heimler

[11] Patent Number: 4,562,336

[45] Date of Patent: Dec. 31, 1985

[54] PREHEATING DEVICE

[76] Inventor: Horst Heimler, Heidelberger Str. 77, 6100 Darmstadt, Fed. Rep. of Germany

[21] Appl. No.: 576,901

[22] Filed: Feb. 3, 1984

[30] Foreign Application Priority Data

Feb. 3, 1983 [DE] Fed. Rep. of Germany ... 8302976[U]

[51] Int. Cl.[4] ..... H05B 1/00

[52] U.S. Cl. ..... 219/282; 219/298; 219/320; 431/208

[58] Field of Search ..... 431/208; 219/431, 440, 219/441, 282, 298, 320; 123/549, 142.5 E

[56] References Cited

U.S. PATENT DOCUMENTS 4,436,983 3/1984 Solobay ..... 219/298

FOREIGN PATENT DOCUMENTS 1108348 6/1961 Fed. Rep. of Germany ... 219/39.41

*Primary Examiner*—Carroll B. Dority, Jr.

*Attorney, Agent, or Firm*—Sandler & Greenblum

[57] ABSTRACT

In order to achieve a constant, virtually optimal temperature of the fuel oil supplied to a burner and prevent any local overheating even when the burner malfunctions or is temporarily switched off, a preheating device for fuel oil to be installed in the fuel supply path is provided which comprises a chamber having an inlet for the oil to be preheated, this inlet being directly connected with the central passage of a first heating cartridge arranged within the chamber, and a second heating cartridge following the first, arranged in a cup-shaped vessel in such a way that a pressure chamber is formed between the bottom of the cup and a front surface of the second heating cartridge, this pressure chamber communicating with the inside of the chamber via a narrow annular gap extending along the length of the second heating cartridge between the outer walling of this cartridge and the inner walling of the cup-shaped vessel. An immersion pipe leads from the central passage of the first heating cartridge to the vicinity of a closed end of the central passage of the second heating cartridge. Due to the specially designed path of flow, heat transmission from the heating cartridges to the fuel oil is good.

7 Claims, 1 Drawing Figure

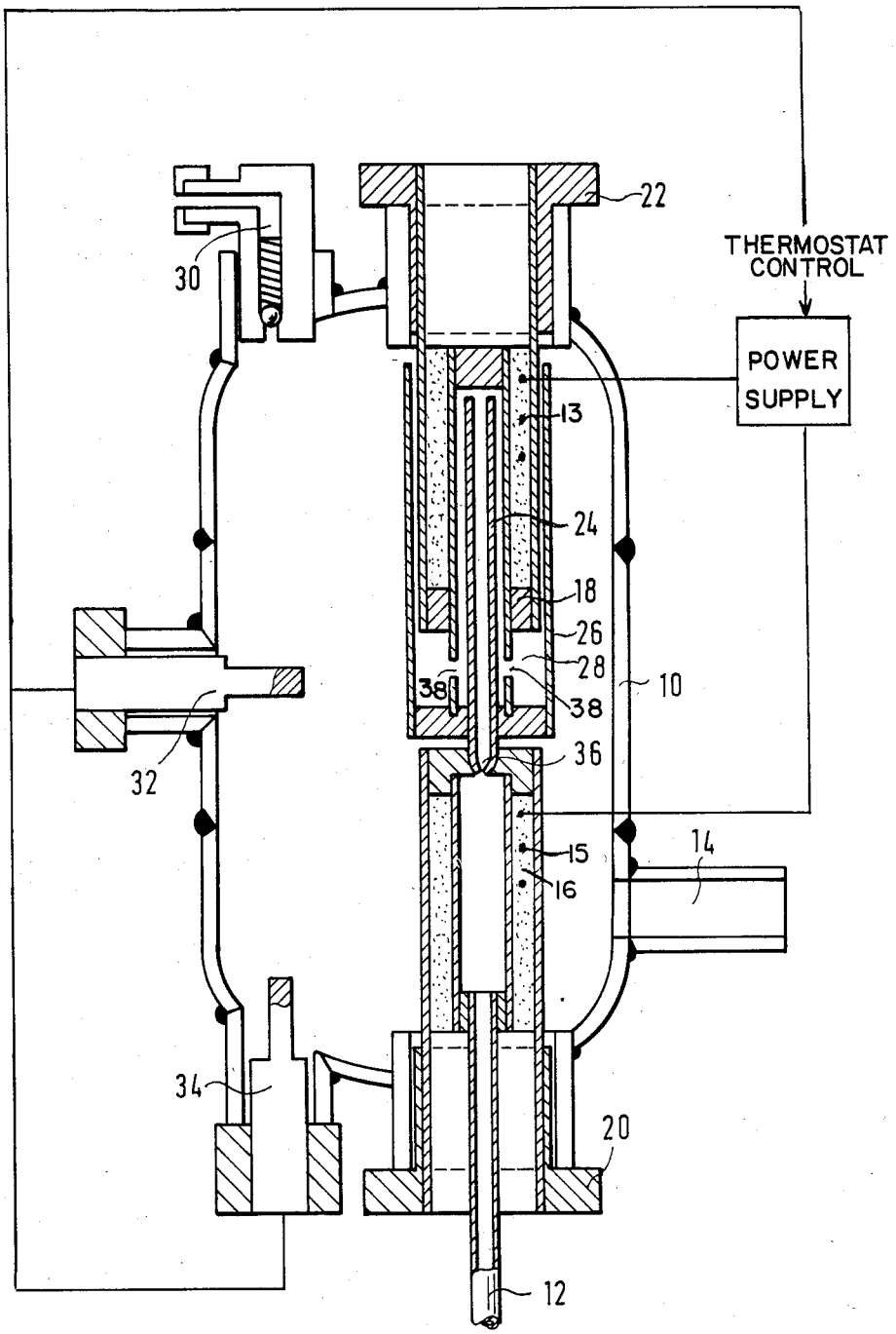
THERMOSTAT CONTROL
POWER SUPPLY
22
30
13
24
18
26
28
38
38
10
36
32
15
16
14
34
20
12

PREHEATING DEVICE

FIELD OF THE INVENTION

The present invention relates to a preheating device for fuel oil which is installed between the oil pump and the burner, preferably in a boiler furnace operating with oil.

DISCUSSION OF PRIOR ART

It is known that the efficiency of boiler furnaces using oil can be improved by preheating the fuel oil to be combusted. Preheating the fuel oil reduces its viscosity, improving atomization, on the one hand, and reducing the flow rate through the burner heads on the other. The finer atomization leads to a more complete combustion of the fuel oil free of residue, so that a greater quantity of heat can be generated in spite of a smaller rate of flow. Combustion free of residue allows for longer maintenance intervals, the transmission of heat to the actual heat transfer medium remaining virtually optimal and the emission of pollutants being reduced.

It is already known to have the oil pumped from a tank to the burner flow through electrically driven heating cartridges, preheating it accordingly. However, it is difficult to regulate the heating capacity of such cartridges; in case of a standstill, local overheating or formation of steam in the oil conduit may occur, which is extremely undesirable and dangerous. The electrical energy supplied during preheating must of course be lower than the energy which may be saved by higher efficiency of combustion. Known heating cartridges generally do not work as efficiently since loss of heat into the surroundings cannot be prevented.

The invention is based on the problem of developing a preheating device of the above-mentioned type which guarantees a constant, virtually optimal temperature of the fuel oil supplied to the burner, and which does not lead to any local overheating even when the burner malfunctions or is temporarily switched off.

SUMMARY OF THE INVENTION

This problem is solved according to the invention by the features stated in the characterizing part of the main claim. In a pressure vessel whose volume is so great that it acts like a kind of buffer, two heating cartridges are connected in series in such a way that the oil entering the pressure chamber flows first through the interior of the first heating cartridge and then through the interior of the second heating cartridge via an immersion pipe, whereupon the oil is forced by a deflection to flow along the outer wall of the second heating chamber, and only then enter inside the pressure vessel. The temperature of the fuel oil stored in the pressure vessel is kept at the operating temperature by the heat released via the outer surface of the first heating cartridge. Advantageous developments of the invention are the subject-matter of the subclaims.

The invention is particularly advantageous in that virtually 100% of the electrical heating capacity of the heating cartridges is supplied to the fuel oil, since there is no loss of heat into the surroundings whatsoever. Due to the specially designed path of flow, heat transmission from the heating cartridge to the fuel oil is good, or the heat transfer coefficient is high, so that the heating cartridges may have correspondingly small dimensions. Due to the buffer effect of the fuel oil intermediately stored in the pressure vessel, oil is supplied to the burner at a constant, virtually optimal temperature, thus minimizing the flow rate and optimizing atomization. At the beginning of each heating cycle the pressure in the pressure vessel increases due to the heat expansion of the enclosed oil volume, since flow back to the pump is prevented by means of an appropriate check valve. When the burner head is opened, there is sudden pressure compensation with correspondingly fine atomization, effectively preventing soot formation even during the ignition process.

BRIEF DESCRIPTION OF THE DRAWINGS

In the following, an embodiment of the invention shall be described by way of example with reference to the enclosed drawing. The single FIGURE shows a schematic cross-section of a preheating device.

DETAILED DESCRIPTION OF THE DRAWINGS

The device comprises a pressure-proof chamber 10, which is cylindrical in the embodiment shown. The chamber is supplied via an intake pipe 12 by a centrifugal pump (not shown) and is connected with the burner, or rather the burner head, of a boiler furnace via an outlet pipe 14. In the interior of the chamber 10 there are a first heating cartridge 16 and a second heating cartridge 18 arranged coaxially and one behind the other. Heating cartridges 16, 18 are cylindrical and each exhibits a tubular central passage. Heating elements 13 and 15 are provided to heat the cartridges.

Appropriately dimensioned short mounting pipes 20, 22 are provided for the introduction of the heating cartridges into the chamber. The embodiment shown may of course be varied in such a way that the two heating cartridges one behind the other may be introduced into the chamber through only one short pipe.

The central passage of the first heating cartridge 16 is at one end sealingly connected with intake pipe 12 and at the other end with an immersion pipe 24 connecting the interior of the first heating cartridge 16 with the interior of the second heating cartridge 18. Immersion pipe 24 extends up to just before the end of the central passage of the second heating cartridge which is closed by an appropriate seal.

The second heating cartridge 18 is placed in a cup-shaped vessel 26 in such a way that the opening of the central passage is opposite the bottom of the cup. A pressure chamber 28 is thus formed between heating cartridge 18 and the bottom of cup 26.

The diameter of vessel 26 is greater than the outer diameter of heating cartridge 18 so that a narrow annular gap is formed around heating cartridge, the gap 18 extending virtually along the entire length of heating cartridge 18.

In the embodiment shown, the central passage of heating cartridge 18 has a tubular extension and is connected with the bottom of cup-shaped vessel 26. In the tubular extension leak bores are arranged connecting the interior of heating cartridge 18 with the actual pressure chamber 28. The annular gap between heating cartridge 18 and the inner walling of cup-shaped vessel 26 opens into chamber 10.

The chamber also exhibits a vent and safety valve 30 which responds when a maximum pressure is exceeded and which feeds excess oil to the feedback conduit of the pump to the tank. The chamber is further provided with a temperature sensor 32 which controls the two heating cartridges 16, 18 in such a way that the temperature of the fuel oil located in chamber 10 does not fall below 65° C. and does not exceed 95° C. This interval may of course be adjusted differently or made smaller.

As shown in the FIGURE an unreferenced power supply is conventionally controlled by a thermostat, which is connected to temperature sensors 32 and 34, thereby controlling the temperature of the first and second heating cartridges (16 and 18), respectively. This is a conventional system for controlling the heat generated.

Finally, a safety temperature sensor 34 is also provided in the chamber to interrupt further heating of heating cartridges 16, 18 when a certain maximum temperature, e.g., an oil temperature of 110° C., is exceeded.

Safety valve 30 has a double function; in addition to limiting pressure, this valve may also be used to blow off the air which accumulates during filling.

Chamber 10 may be surrounded by insulation (not shown) which prevents loss of heat towards the exterior, thus assuring a constant operating temperature. A suspension device for attachment to the boiler jacket may be provided on the insulation or casing.

The measuring signals of temperature sensors 32, 34 are fed to an electronic temperature regulator (not shown), constructed, for example, on an IC basis, which may be designed in such a way, for example, that the fuel oil flowing through the device is always at a temperature between 70° C. and 90° C.

It has proved to be advantageous to provide a throttle orifice 36 at the end of the central passage of the first heating cartridge 16, the throttle effect of which must of course not be greater than the throttle effect of the burner head.

In one practical embodiment of boilers now in use, chamber 10 may have a volume of approximately 0.5–1 liter. Depending on the desired flow rate, the volume may of course be larger or smaller.

The device works in the following manner. The oil entering through intake pipe 12 is heated in the interior of the first heating cartridge 16; throttle orifice 36 regulates to a certain extent its sojourn time through the first heating cartridge. The oil then reaches, via immersion pipe 24, the bottom of the interior of the second heating cartridge 18 and flows "backwards" in the annular passage between immersion pipe 24 and the inner wall of heating cartridge 18, entering pressure chamber 28 via leak bores 38. From pressure chamber 28 it flows through the annular gap along the outer surface of heating cartridge 18 into the interior of the actual chamber 10. The temperature of the fuel oil located in chamber 10 is maintained to a great extent by the heating capacity of the first heating cartridge 16, which releases heat via its outer wall to the oil located in the interior of chamber 10.

The oil in the chamber is under a certain pressure which is maintained by the centrifugal pump supplying the chamber.

When the furnace is started up, the filled chamber 10 is heated, the oil expands and the pressure increases beyond the normal operating pressure since an appropriately arranged check valve prevents the oil from flowing back from the chamber towards the pump. When a certain desired pressure is reached, e.g. a pressure of 16 bar compared to 9 bar operating pressure, the burner head opens and the atomized jet of fuel oil is ignited. The high pressure leads to very fine atomization, which facilitates ignition on the one hand, and which assures combustion which is particularly free of residue on the other hand, so that no soot deposits can be placed on the boiler, even during ignition. The excess pressure present before ignition is, of course, immediately reduced so that chamber 10 in the operating state is under a pressure of, for example, 9 bar, resulting, on one hand, from the pump characteristics and, on the other hand, from the some of the flow resistances.

Modifications in the construction of the embodiment shown are obviously possible without any deviation from the inventive concept itself.

I claim:

1. A preheating device for fuel oil adapted to be attached to a furnace between a furnace oil pump and a furnace burner, said preheating device including at least two heating cartridges each having electrical heating means through which fuel oil is adapted to flow when said device is installed between said oil pump and said burner, said preheating device comprising:

(a) a first pressure-proof chamber having an inlet for receiving oil to be preheated;

(b) a first heating cartridge positioned within said chamber, said first heating cartridge having a central passage and being directly fluidically connected to said inlet;

(c) a second heating cartridge adjacent said first heating cartridge, said second heating cartridge having an outer wall and being positioned within a generally cup-shaped vessel, said vessel having a bottom and said second heating cartridge having a front surface, a second pressure chamber being located between said vessel bottom and said second heating cartridge front surface, a substantially narrow angular gap being located along the length of said second heating cartridge and being formed between said outer wall of said second heating cartridge and an inner surface of said cup-shaped vessel, said second heating cartridge including a central passage, said central passage being closed at one end of said second cartridge and open at a second end of said second cartridge, said second end being located adjacent said second pressure chamber;

(d) an immersion pipe extending from a central passage of said first heating cartridge to an area adjacent said closed end of said second heating cartridge, said immersion pipe extending through said vessel bottom; and (e) a conduit extending outwardly from said first pressure-proof chamber, said conduit adapted to conduct fuel oil from said chamber to said furnace burner when said device is attached to said furnace.

2. A preheating device in accordance with claim 1 further comprising at least one mounting pipe positioned about each of said heating cartridges, each said heating cartridge thereby being coaxially positioned within a respective one of said mounting pipes.

3. A preheating device in accordance with claim 1 further comprising a first temperature sensor comprising means for measuring the temperature of fuel oil within said chamber and a second temperature sensor comprising means for turning off said heating cartridge when the temperature of fuel oil within said chamber exceeds a predetermined temperature.

4. A preheating device in accordance with claim 1 further comprising a safety valve attached to said chamber, said safety valve comprising means for conducting fuel oil through said safety valve when a predetermined pressure is exceeded within said chamber.

5. A preheating device in accordance with claim 1 attached to a furnace burner having a fuel line with a throttle, one end of a central passage of said first heating cartridge comprises a throttle orifice, said throttle orifice having a throttle resistance which is smaller than the throttle resistance of the head of said furnace burner to which said preheating device is attached.

6. A preheating device in accordance with claim 1 wherein said second heating cartridge central passage includes a passage tube which extends beyond said front surface of said second cartridge and into said cup-shaped vessel bottom, said passage tube including at least one leak bore positioned within said second pressure chamber and comprising means for fluidically connecting said passage tube with said second pressure chamber.

7. A preheating device in accordance with claim 6 wherein said passage tube of said second heating carriage is positioned about said immersion pipe, said second heating cartridge outer wall extends about said passage tube, said cup-shaped vessel extends about said second cartridge, wherein said immersion pipe, said passage tube, said second heating cartridge, and said cup-shaped vessel are concentrically arranged.

* * * * *